US007098792B1

(12) United States Patent
Ahlf et al.

(10) Patent No.: US 7,098,792 B1
(45) Date of Patent: Aug. 29, 2006

(54) TAMPER PROOF SYSTEM AND METHOD

(75) Inventors: Paul R. Ahlf, Oak Creek, WI (US); Gregg J. Haensgen, Menomonee Falls, WI (US); Dan L. Hurrle, Menomonee Falls, WI (US); Mark A. Gilbertson, Prairie du Sac, WI (US); William J. Nitz, Sun Prairie, WI (US)

(73) Assignee: RF Technologies, Inc., Brookfield, WI (US)

( * ) Notice: Subject to any disclaimer, the term of this patent is extended or adjusted under 35 U.S.C. 154(b) by 98 days.

(21) Appl. No.: 10/844,036

(22) Filed: May 12, 2004

Related U.S. Application Data

(60) Provisional application No. 60/470,467, filed on May 14, 2003.

(51) Int. Cl.
*G08B 13/14* (2006.01)

(52) U.S. Cl. ..... 340/568.1; 340/572.1; 340/572.8; 340/988; 235/492

(58) Field of Classification Search ..... 340/568.1, 340/572.1, 572.8, 988; 235/492
See application file for complete search history.

(56) References Cited

U.S. PATENT DOCUMENTS 5,075,670 A 12/1991 Bower et al.
5,298,884 A 3/1994 Gilmore et al.
5,541,578 A 7/1996 Lussey
5,644,295 A * 7/1997 Connolly et al. ..... 340/568.1
5,793,290 A 8/1998 Eagleson et al.
5,867,103 A 2/1999 Taylor, Jr.
5,883,576 A 3/1999 De La Huerga
5,959,533 A 9/1999 Layson, Jr. et al.
6,150,921 A 11/2000 Werb et al.
6,262,664 B1 7/2001 Maloney
6,408,330 B1 6/2002 DeLaHuerga
6,570,504 B1 5/2003 Rabanne et al.
6,593,845 B1 7/2003 Friedman et al.
6,603,387 B1 8/2003 Addy et al.
6,608,551 B1 8/2003 Anderson et al.
2002/0036237 A1* 3/2002 Atherton et al. ..... 235/492
2002/0089434 A1* 7/2002 Ghazarian ..... 340/988
2002/0135481 A1* 9/2002 Conwell et al. ..... 340/572.1
2003/0031819 A1* 2/2003 Adams et al. ..... 428/40.1

* cited by examiner

*Primary Examiner*—Jeffery Hofsass
*Assistant Examiner*—Samuel J. Walk
(74) *Attorney, Agent, or Firm*—Foley & Lardner LLP

(57) ABSTRACT

A monitoring, tracking or security system includes a tamper detection system or employs a tamper detection method. A tamper detection system can include a member having a first surface and a second surface, the second surface being attached to a piece of equipment. The sensing element is disposed on the first surface of the member. The housing is attached to the first surface. A circuit is electrically coupled to the sensing element. The circuit provides an alarm signal in response to the sensing element being distorted.

16 Claims, 7 Drawing Sheets

TAMPER PROOF SYSTEM AND METHOD

This application is an application claiming the benefit under 35 USC 119(e), U.S. Application 60/470,467, filed May 14, 2003, incorporated herein by reference in its entirety.

BACKGROUND OF THE INVENTION

Automated systems have been developed for securing, monitoring, tracking and locating personnel and equipment. Such systems are typically utilized to prevent theft, misplacement, escape or other losses associated with personnel and equipment as well as to protect secured areas. In general, conventional automated systems have utilized an electronic device or tag unit, which is attached to the person, or equipment being monitored, secured or tracked. The electronic device or tag unit can be an active or passive device.

In one conventional system, such as, the article tracking system disclosed in U.S. Pat. No. 6,150,921, a radio frequency identification system includes three components: (1) a tag, (2) an interrogator, and (3) a control system. The interrogator detects the tag when it passes within an appropriate range. In other systems, the tag or electronic device attached to the person or equipment can actively and periodically provide a signal that indicates the location of the person or equipment. The signal provided by the tag is received by a control center that tracks the location of the item.

Other conventional systems include PIN POINT™ asset tracking systems manufactured by RF Technologies, Inc. the assignee of the present application. Such systems include electronic tags that utilize low power radio signals to provide instantaneous location of any asset or person. The system can maintain a complete log of movements for auditing security, generate instant inventory of all tagged assets, trigger alerts if the tag leaves or enters specified areas, and monitor and control access to and movements of assets. These conventional systems can be utilized in hospitals, industrial/commercial environments and high level security environments.

To prevent removal of the electronic devices or tags (which can thwart the effectiveness of the monitoring or security system), the tags or electronic devices must generally be attached to the equipment or personnel via a tamper prevention or tamper detection system. The tamper detection system senses when the electronic device or tag is removed from the equipment or person. One conventional tamper detection system relies on a conductive strap that is attached to the person or equipment and the tag. If the conductive strap is cut to remove the electronic device or tag from the person or equipment, a circuit senses that the resistance across the strap is increased and provides an alarm. The alarm can be provided audibly or can be provided to a central control system via a wireless signal.

Heretofore, tamper detection systems have been difficult to manufacture for a variety of equipment. For example, straps are generally not desirable for equipment that has relatively flat surfaces. Further, if such straps are connected through non-essential portions of the equipment, such as, handles, the handle can be removed, thereby allowing the equipment to be removed from the tag or electronic device.

Therefore, there is a need for a tamper detection electronic tag which is optimized for attachment to equipment. Further still, there is a need for a more robust, tamper detection system that is less susceptible to false alarms. Yet further, there is a need for a tamper detection system and method that is easy to implement and easy to install.

SUMMARY OF THE INVENTION

One embodiment relates to a tamper detection system for an electronic monitoring or security device. The system includes a member having a first surface and a second surface, a sensing element, a housing, and a circuit. The second surface of the member is attached to a piece of equipment, and the sensing element is disposed on the first surface of the member. The housing is attached to the first surface and the circuit is electrically coupled to the sensing element. The circuit provides an alarm signal in response to the sensing element being distorted.

Yet another exemplary embodiment relates to a monitoring system. The monitoring system includes means for being attached to a person or piece of equipment, means for providing an electrical path, and means for determining if a characteristic of the electrical path has changed. The monitoring system also includes means for housing the means for providing. The means for housing is disposed between the means for being attached and the piece of equipment or person. The characteristic of the electrical path is changed if the means for being attached is removed from the person or the piece of equipment.

Still another exemplary embodiment relates to a method of tamper detecting an electronic device attached to a piece of equipment. The method includes providing a sensing element on a flexible member, and electrically coupling the electronic device to the sensing element. The method also includes attaching the flexible member to the piece of equipment.

Yet another embodiment relates to an electronic monitoring or security system. The system includes an electronic device for monitoring or securing a person or thing, a member, a sensing element, and a circuit. The member has a first surface and a second surface. The second surface is attached to the person or thing. The sensing element is disposed on the first surface of the member. The electronic device is attached to the first surface. The circuit is electrically coupled to the sensing element and provides an alarm signal in response to the sensing element being distorted.

Yet another exemplary embodiment relates to a tamper detection system for an electronic monitoring or security system. The system includes a housing for being attached to a piece of equipment by a means for attaching. The system also includes a sensing element and a circuit. The housing holds an electronic monitoring or security device or tag. The housing is configured so that the electronic monitoring or security device or tag covers the means for attaching when held in the housing. The sensing element is disposed on the housing between the electronic monitoring or security device or tag and the housing. The circuit is electrically coupled to the sensing element and is disposed with the electronic monitoring or security device or tag. The circuit provides an alarm in response to the sensing element being uncoupled from the electronic monitoring or security device or tag.

BRIEF DESCRIPTION OF THE DRAWINGS

Exemplary embodiments will hereafter be described with reference to the accompanying drawings, wherein like numerals denote like elements, and.

DETAILED DESCRIPTION OF THE PREFERRED EXEMPLARY EMBODIMENTS

Figure 1:
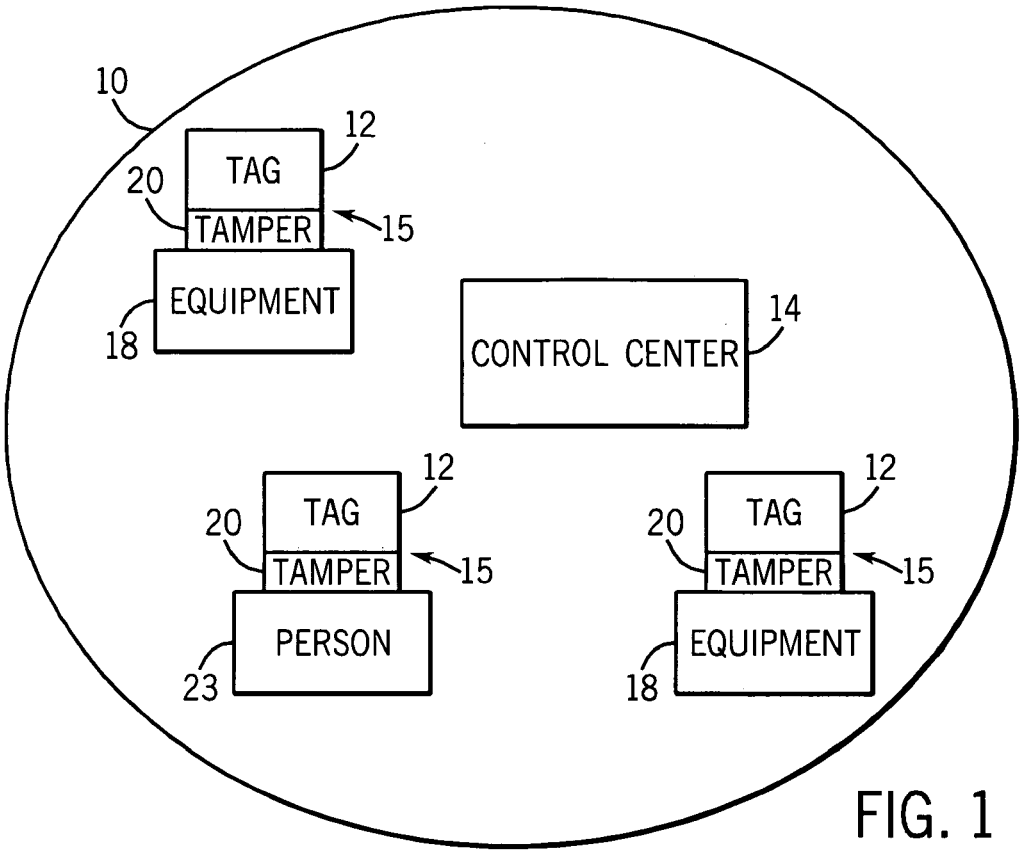
FIG. 1 is a schematic general block diagram of a security or monitoring system including an electronic device or tag with a tamper detection system in accordance with an exemplary embodiment.

With reference to FIG. 1, a monitoring, tracking or security system 10 is provided in an environment for tracking people and things, such as, equipment 18 and person 23. Equipment 18 can include medical equipment, electronic equipment, manufacturing equipment, vehicles, video equipment, computer equipment or any apparatus that is desirous to track to prevent theft or misplacement. Person 23 can be any human or animal for which monitoring or tracking is desired including prisoners, children, infants, livestock, employees, etc. System 10 can be any type of monitoring, tracking or security system that utilizes electronic devices or tags attached to equipment or personnel.

In one embodiment, system 10 includes security tags or electronic devices 15 attached to equipment 18 and person 23. Electronic devices 15 can be attached to equipment 18 and person 23 through a tamper prevention or tamper detection system 20. A tag circuit 12 associated with device 15 can provide necessary communication to a control center 14. In one embodiment, electronic device 15 provides infrared or RF communication through a network or directly to control center 14 to assist tracking of equipment 18 and person 23. In an alternative embodiment, electronic device 15 can be passive and respond to an interrogator provided at a location. Preferably, system 10 is similar to an area security system, such as, the system disclosed in U.S. Pat. No. 5,793,290 and assigned to the assignee of in the present application or a PIN POINT asset tracking system manufactured by RF Technologies, Inc., the assignee of the present application. Device 15 preferably communicates identification information to a network in communication with control center 14 or directly to control center 14.

In one embodiment, electronic device 15 can provide location information. Electronic device 15 can include a transceiver for actively transmitting and receiving messages from other devices 15, networks and control center 14. Electronic device 15 can include GPS chip sets and actively determine its own location. Various types of monitoring, tracking or security systems and tags or electronic devices can be utilized without departing from the scope of the present invention.

Tag circuit 12 and tamper detection system 20 can include electronic components that are implemented by a variety of technologies. For example, application specific integrated circuits (ASICs), microcontrollers executing software, RF circuits, infrared circuits, and discreet components can all be utilized to provide the functions described in the present application. Preferably, tamper detection system 20 includes a control or alarm circuit provided on a control circuit board associated with tag circuit 12.

Figure 2:
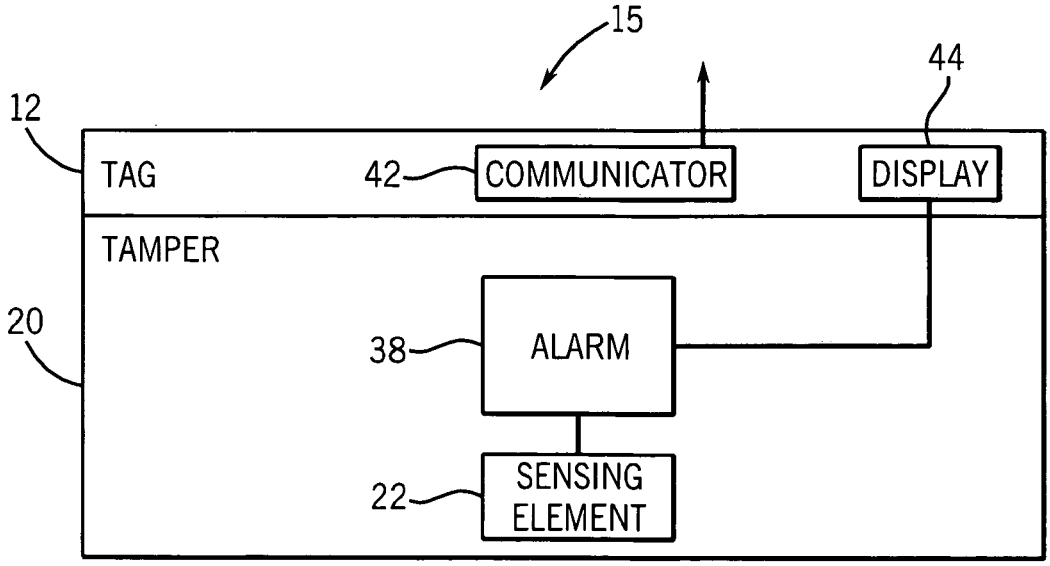
FIG. 2 is a schematic more detailed general block diagram of the electronic device or tag with the tamper detection system illustrated in FIG. 1.

With reference to FIGS. 1 and 2, tag circuit 12 of device 15 includes a communicator 42 which can provide communication to a network attached to control center 14 or to control center 14 directly. Communicator 42 can be an infrared or RF communication system.

In an alternative embodiment, tag circuit 12 does not include communicator 42 and is a passive device that responds to an interrogator. Tag circuit 12 can be implemented in a variety of configurations and provide a variety of additional security, location, and communication functions.

Tamper detection system 20 includes a sensing element 22 and an alarm circuit 38. Alarm circuit 38 monitors sensing element 22 and determines whether device 15 has been removed from equipment 18 or person 23. Circuit 38 can be located with tag circuit 12 while sensing element can be located remote from tag circuit 12 (e.g., closer to equipment 18).

In operation, sensing element 22 becomes distorted or open circuited when electronic device 15 is improperly removed from equipment 18 or person 23. Alarm circuit 38 provides an alarm signal which can be provided to display 44 when element 22 is distorted or open circuited. Display 44 can be a light-emitting diode display, a liquid crystal display or other visual display that provides an indication of the presence of the alarm signal. In addition, display 44 can include a speaker, buzzer, alarm or be an audio display that provides an alarm sound in response to the alarm signal. Alternatively, communicator 42 can provide an indication of the alarm signal to control center 14 to inform others that device 15 has been removed from equipment 18 or person 23.

Alarm circuit 38 can be an ASIC circuit, a comparator circuit, or other device which monitors sensing element 22. Preferably, alarm circuit 38 periodically monitors sensing element 22 to save battery life although constant monitoring is also possible. Alarm circuit 38 can monitor sensing element 22 to determine if an electrical characteristic such as, resistance, is changed.

In one embodiment, a comparator circuit is utilized by alarm circuit 38 to determine if sensing element 22 has been disconnected from alarm circuit 38 or sensing element 22 has been open circuited or otherwise experienced an increase in resistance. The comparator circuit drives an alarm signal in response to the change in the electrical characteristic. Other electronic control techniques can be used to monitor the electrical characteristic of element 22. The comparator circuit can include one input that is coupled to a known resistance and another input that is coupled to a resistance less than the known resistance through sensing element 22.

Tamper detection system 20 is not necessarily impenetrable. Specialized techniques and tools may be utilized to remove device 15 from equipment 18 or person 23 without detection. The term "tamper detection" as used in this application indicates that system 20 provides an alarm when device 15 is removed from equipment 18 or person 23 according to ordinary means. Further, the term "tamper detection system" as used in this application may include tamper resistant system and/or a device that inhibits or discourages tampering.

Sensing element 22 can be any of a variety of elements for allowing alarm circuit 32 to determine whether device 15 has been removed from equipment 18 or person 23. In one embodiment, sensing element 22 is a conductive band or conductive trace. The conductive trace can be a metal foil disposed on a flexible medium.

Devices 15 can be tags manufactured by RF Technologies, Inc. For example, devices 15 can be RF ID tags that receive 2.4 gigahertz (GHz) spread spectrum radio signals from system antennas and respond with a 5.8 gigahertz signal that includes tag identification data. Devices 15 can also be employed in a cell controller network with antennas manufactured by RF Technologies, Inc. and may utilize PIN POINT resource manager software manufactured by RF Technologies, Inc.

Devices 15 are configured to include at least a portion of tamper detection system 20. In one embodiment, alarm circuit 38 is included in tag circuit 12 and includes a pair of contacts provided on the external housing associated with electronic device 15. The contacts are configured to be attached to a foil (e.g., sensing element 22) provided on a flexible member that is attached to equipment 18.

The foil can have a Z-shaped or S-shaped configuration. The S or Z-shaped configuration provides a greater length associated with the conductive trace, thereby increasing the probability that the trace will be torn or otherwise distorted if tag is removed from equipment 18 or person 23. Element 22 can have a variety of patterns, curves or lines.

In one embodiment, the flexible member is attached by a first weaker adhesive to device 15 and a second stronger adhesive to equipment 18 or person 23. The stronger adhesive prevents the flexible member from being removed from equipment 18 without the foil being damaged because the weaker adhesive is peeled away before the stronger adhesive. Peeling the weaker adhesive damages sensing element 22.

Preferably, the foil extends across at least two axes to take advantage of directional properties of adhesives. Adhesives prefer to tear in one direction over another. Sensing element 22 is preferably provided upon the surface of the flexible member attached to the housing of electrical device 15. The opposite surface of the flexible member is attached to equipment 18.

The conductive trace or foil is relatively thin so that hair line separations occur when someone tampers with device 15. Applicants of the present application have found that the below listed preferred dimensions for the conductive trace are particularly advantageous for providing appropriate robustness and yet allowing alarm circuit 38 to sense when tampering has occurred. Preferably, conductive trace is a Z-shaped or S-shaped pattern having a total length of 2.755 inches, a width of 0.1 inches and a thickness of pan microns. Preferably, the trace is aluminum, although any conductive material including copper, solder, etc., can be utilized.

Figure 9:
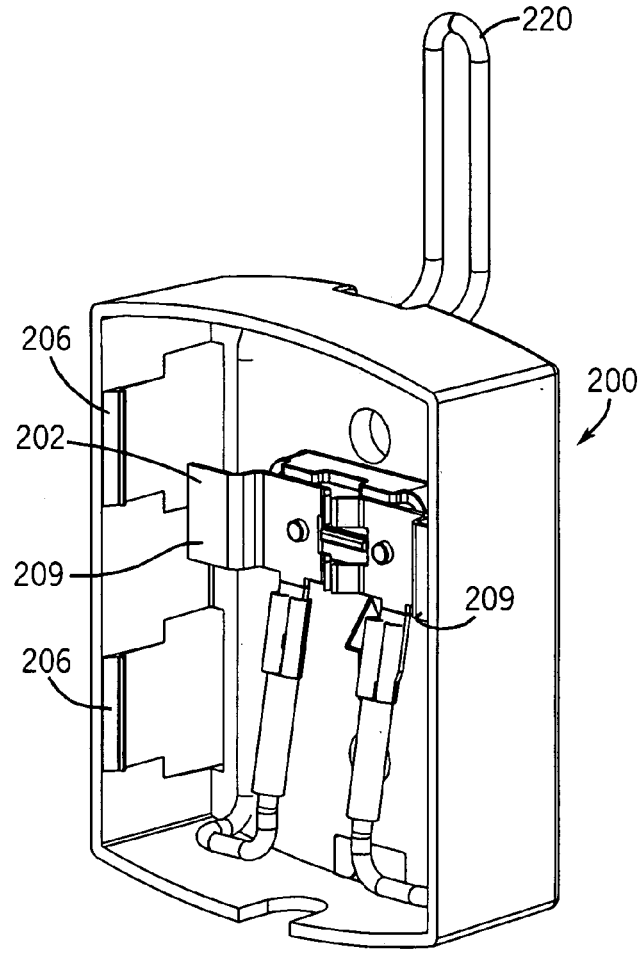
FIG. 9 is a schematic perspective drawing of a housing for the electronic device with the tamper detection system illustrated in FIG. 2 in accordance with still another exemplary embodiment.

According to another embodiment (as shown in FIG. 9), sensing element 22 is disposed in a housing that houses the external housing associated with electronic device 15. Element 22 can be configured as a conductive bent metal strip or a straight contact bar. The housing is configured to hold device 15 with a snap fit. The metal strip is disposed between a back surface of the housing and contacts associated with device 15 are electrically coupled to the strip when device 15 is placed in the housing. The housing is attached to equipment 18 with fasteners. The fasteners cannot be removed without removing device 15 from the housing. Preferably, the fasteners are covered by device 15 when device 15 is held in the housing.

Electrical contacts on the outside surface of device 15 associated with alarm circuit 38 attach to the metal strip or contact bar when device 15 is placed in the housing. A housing embodiment can be utilized in temporary systems in which electronic device 15 does not need to be permanently associated with equipment 18 or person 23.

In another embodiment, a lanyard, a conductive layer, or plastic-coated conductive wire is attached between the contact and is attached to the housing for electric coupling to the contacts of alarm circuit 38. The wire then can be wrapped around person 23 or equipment 18.

Figure 3:
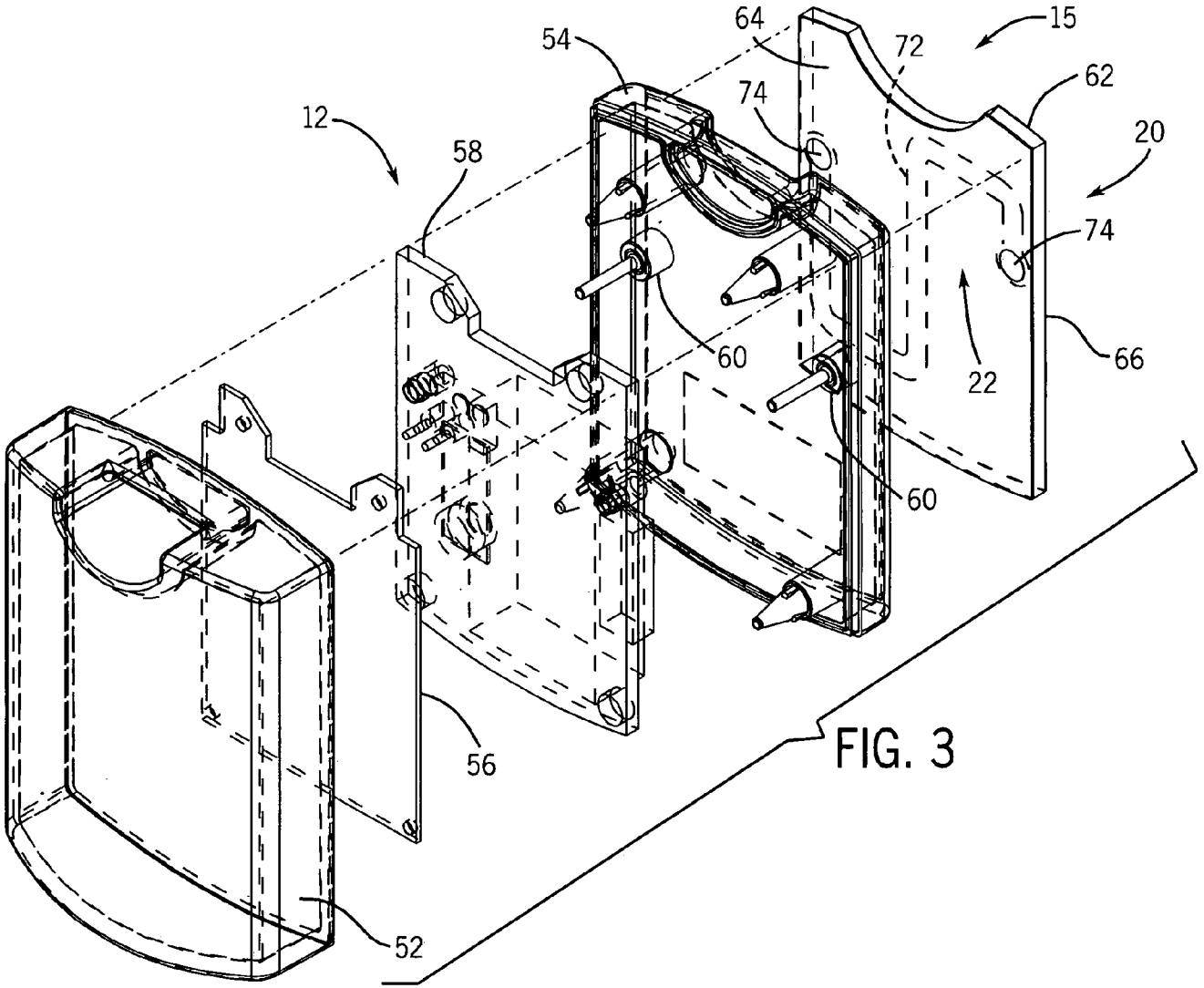
FIG. 3 is a schematic perspective exploded view drawing of the electronic device with the tamper detection system including a flexible member illustrated in FIG. 2 in accordance with another exemplary embodiment.

With reference to FIG. 3, electronic device 15 is comprised of tag portion 12 and tamper detection system 20. Tag portion 12 is comprised of a top housing 52, a bottom housing 54, an antenna printed circuit board assembly 56, and a control circuit assembly 58. Housings 52 and 54 are molded plastic pieces. Control circuit assembly 58 can include alarm circuit 38 (FIG. 2) associated with tamper detection system 20. Alarm circuit 38 is coupled to contacts 60 extending through a back surface of bottom housing 54.

Tamper detection system 20 includes a flexible member 66 having a surface 64 and a surface 62. Surface 64 includes sensing element 22 embodied as a foil or conductive circuit trace 72. Surface 64 is attached to housing 54 by an adhesive.

Contacts 60 are configured to make electrical contact at contact points 74 of conductive trace 72 when surface 64 adheres to housing 54. Contacts 60 are preferably brass, though other metals or alloys may e used. Surface 62 includes an adhesive for attaching to equipment 18. Preferably, the adhesive on surface 62 is a stronger adhesive than the adhesive on surface 64. The adhesive is preferably not provided above contact points 74 to ensure electrical contact. However, a conductive adhesive can be placed above contact points 74 to provide a better tamper connection.

Figure 4:
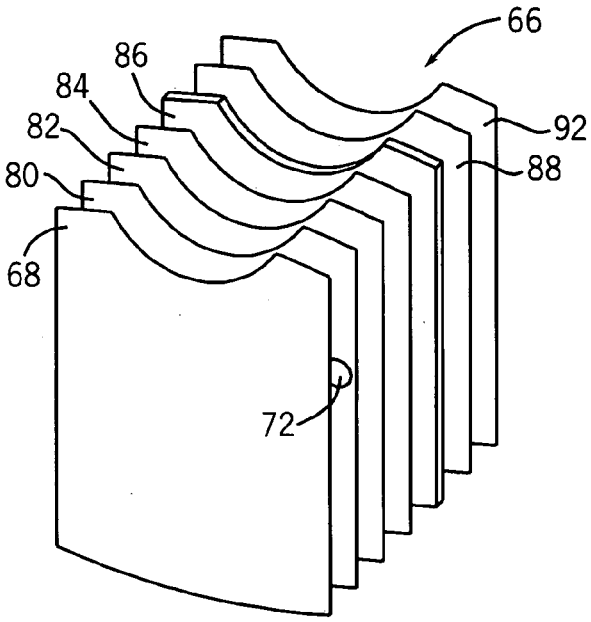
FIG. 4 is a schematic more detailed perspective exploded view drawing of the flexible member for the tamper detection system illustrated in FIG. 3 in accordance with a further exemplary embodiment.

With reference to FIG. 4, flexible element or member 66 can be comprised of a protective sheet 68, an adhesive layer 80, a security layer 82 including conductive trace 72, an adhesive layer 84, a foam layer 86, an adhesive layer 88, and a protective sheet 92. Protective sheets 68 and 92 protect adhesive layers 80 and 88, respectively, and are removed when flexible medium or member 66 is adhered to housing 64 and equipment 18.

Adhesive layer 80 is preferably a "high bond" adhesive having a relatively high "stickiness" or tackiness. Adhesive layer 84 preferably has a tackiness similar to layer adhesive 80. According to an alternative embodiment, adhesive layer 84 is a rolled on adhesive configured to adhere to a foam layer. Adhesive layer 88 is preferably a lower bond adhesive having a relatively low tackiness (e.g. compared to the tackiness of layer 80). According to an alternative embodiment, adhesive layer 88 is a rolled on adhesive.

Foam layer 86 is preferably a 25 to 75 mil thickness layer of a foam, such as polyurethane foam. Liner or security layer 82 preferably has a thickness of about 1 to 10 mil, suitably about 2 to 3 mil, including an aluminum trace such as trace 74 as element 22.

Member 66 can have a height of 1.5 inches and a width of approximately 1.2 inches, and is preferably dimensioned in accordance with housing 54. Housing 54 or electronic device 15 can be configured in any of a variety of shapes. The shapes and sizes shown and addressed in the present application are not provided in a limiting fashion.

A preferred embodiment of flexible element of member 66 can utilize a simplified structure. With reference to FIG. 4, layers 80, 84 and/or 88 can be eliminated. With such a simplified structure, a foam layer as similar to layer 86 can be purchased with adhesive sides that are already part of the foam layer. The adhesive is preferably sufficiently aggressive that an ordinary attempt to remove device 15 distorts the foam and opens conductive trays 72. According to a preferred embodiment, the foam layer with adhesive sides is a model no. 4945 very high bond (VHB) double coated acrylic foam tape commercially available from 3M Company of Saint Paul, Minn.

Figure 5:
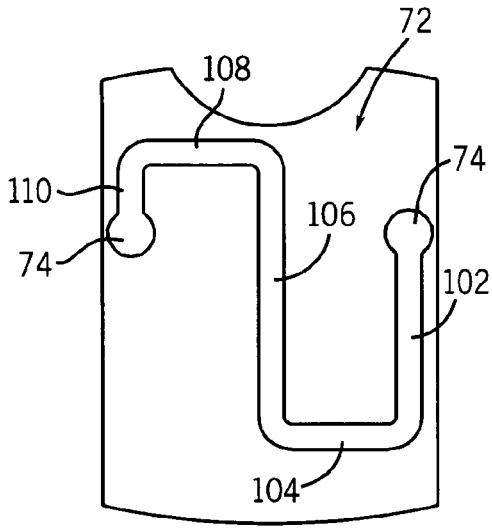
FIG. 5 is a schematic more detailed planar top view drawing of the flexible member illustrated in FIG. 4 in accordance with yet another exemplary embodiment.

With reference to FIG. 5, an exemplary conductive trace 72 includes a first portion 102 having a length of 0.647 inches and a preferred width of 0.1 inches, and a second portion 104 disposed at a 90-degree angle with respect to portion 102 having a width of 0.496 inches and a thickness of 0.1 inches. Trace 72 also includes a portion 106 having a length of 0.876 inches and a width of 0.1 inches. Portion 106 is disposed at a 90-degree angle with respect to portion 104 and parallel to portion 102. Portion 108 has a length of 0.496 inches and width of 0.1 inches and is disposed at a 90-degree angle with respect to portion 106 and parallel to portion 104. A portion 110 is a length of 0.229 inches and width of 0.1 inches and is disposed parallel to portion 106 and perpendicular to portion 108. The S or Z-shaped nature of trace 72 provides significant advantages as it increases the likelihood that trace 72 breaks when the adhesive is torn in one or more directions when device 15 is removed from equipment 18 or person 23. Trace 72 is preferably an aluminum trace. Trace 72 includes contact areas or pads 74 for receiving contacts 60 on surface 54.

Figure 6:
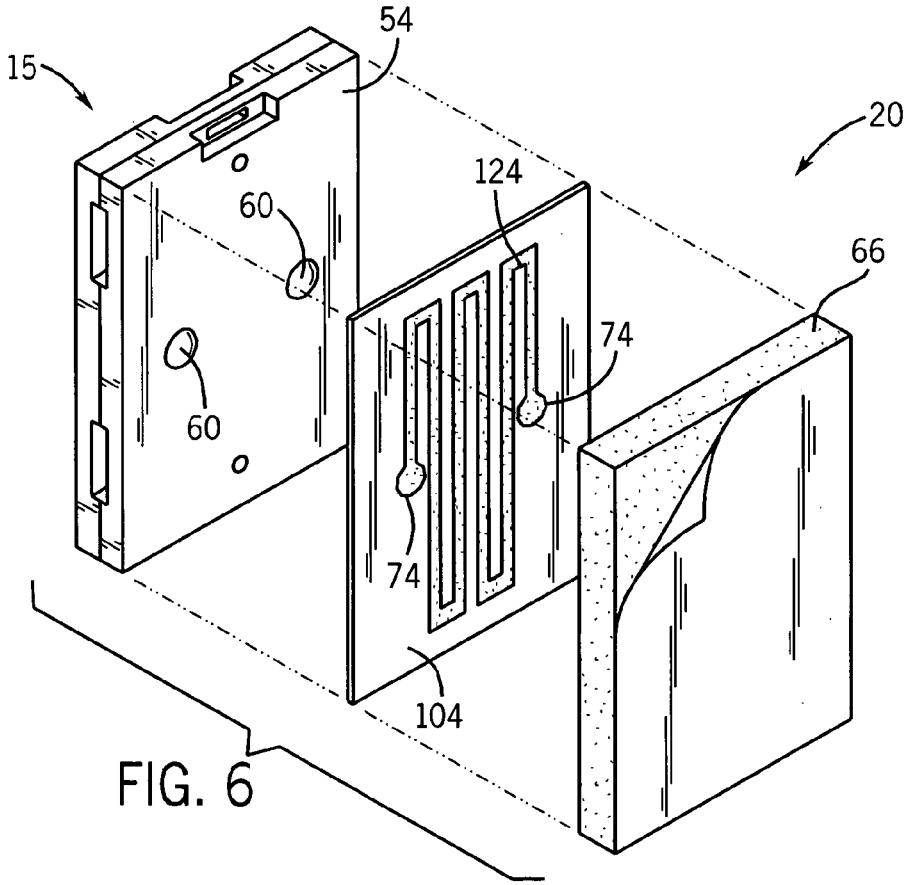
FIG. 6 is a schematic perspective exploded view drawing of the electronic device with the tamper detection system illustrated in FIG. 2 in accordance with still another exemplary embodiment.

With reference to FIG. 6, an alternative embodiment of tamper detection system 20 is shown. Tamper detection system 20 includes flexible medium 66 comprised of double-sided VHB adhesive foam tape. The adhesive foam tape is attached to a 3M stamped adhesive metal foil 104 commercially available from 3M Company of Saint Paul, Minn., including a conductive trace 124. Conductive trace 124 has more undulations than conductive trace 72 discussed with reference to FIG. 3.

Figure 7:
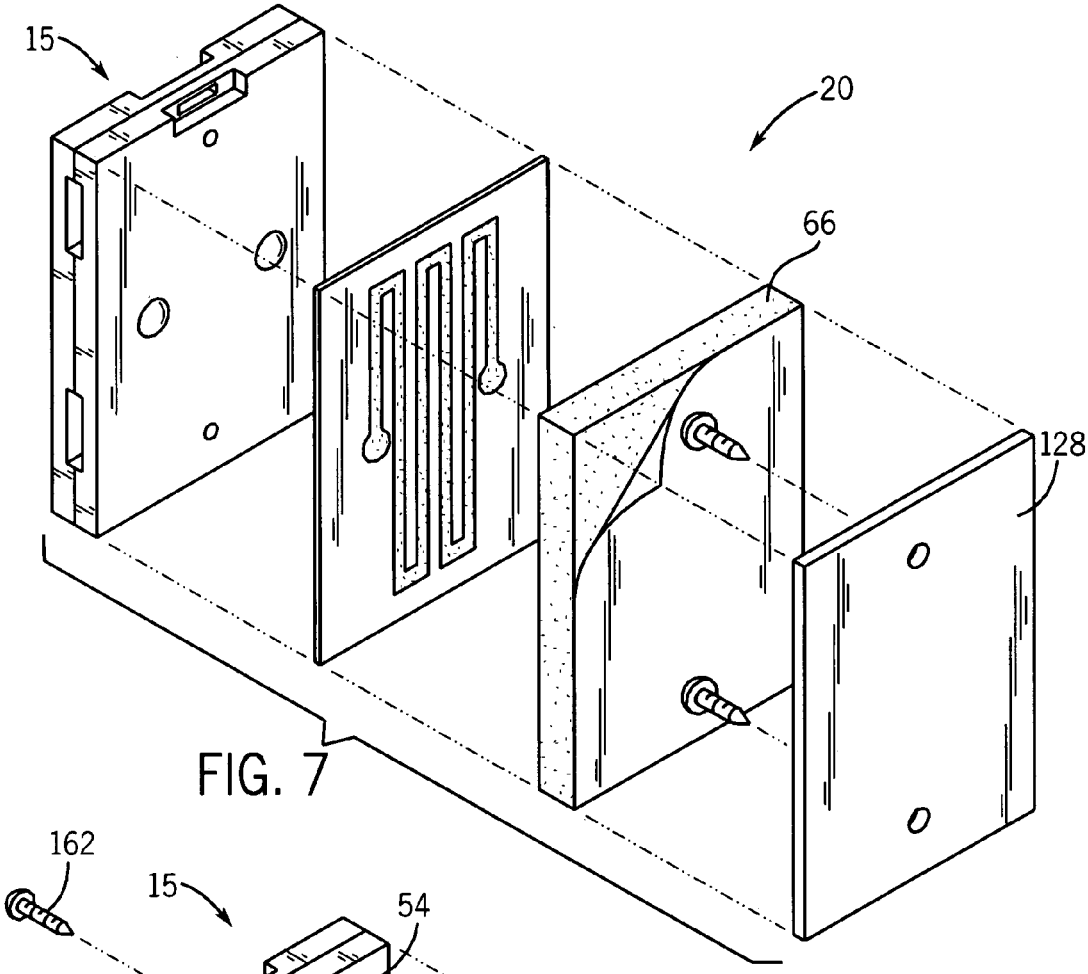
FIG. 7 is a schematic perspective exploded view drawing of the electronic device with the tamper detection system illustrated in FIG. 2 in accordance with another exemplary embodiment.

With reference to FIG. 7, electronic device 15 includes flexible medium 20 coupled to a die-cut metal or plastic plate 128. Plate 128 can be fastened to equipment 18. In this way, system 20 can be utilized with equipment 18 that is not compatible with the adhesive associated with flexible member 66. For example, plate 128 can be screwed into a wood crate, or wood furniture. Plate 128 can also be utilized with the embodiment of flexible medium 66 discussed with reference to FIGS. 3–5.

Figure 8:
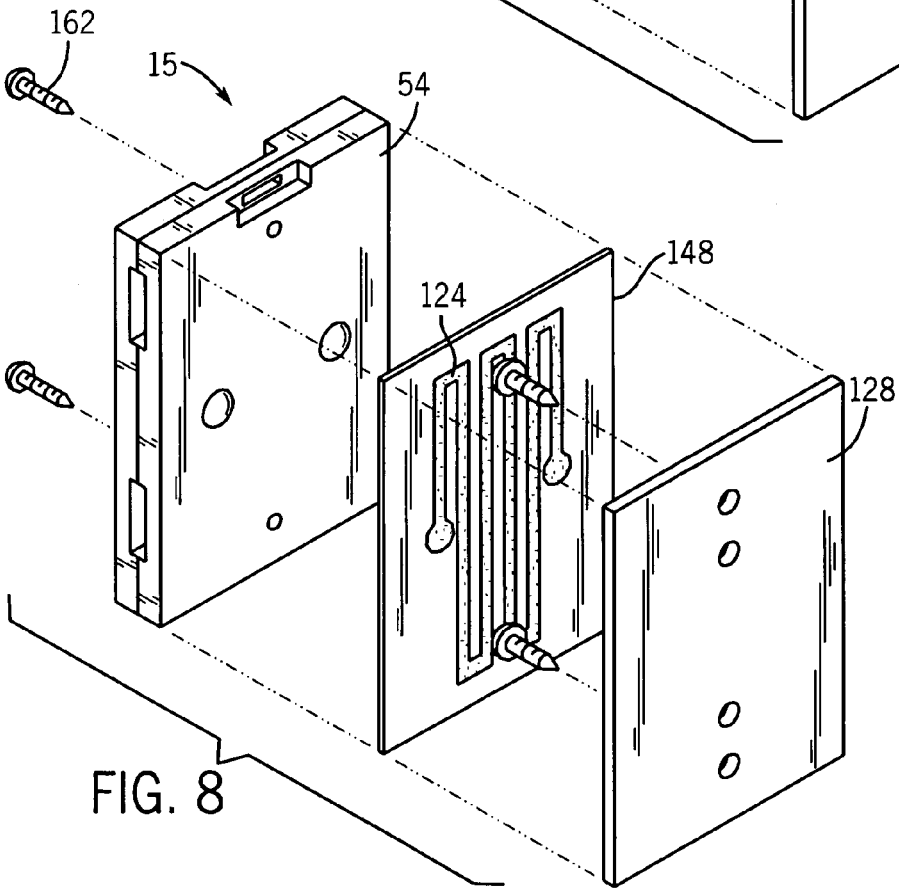
FIG. 8 is a schematic perspective exploded view drawing of the electronic device with the tamper detection system illustrated in FIG. 2 in accordance with yet another exemplary embodiment.

With reference to FIG. 8, electronic device 15 utilizes a contact strip 148 without a foam tape. Contact strip 148 includes a conductive trace 148. Contact strip 148 includes adhesive on both its flat surfaces. Strip 124 can be adhered directly to equipment 18 or utilize plate 128. Contract strip is preferably aluminum or any other similar conductive material.

Figure 10:
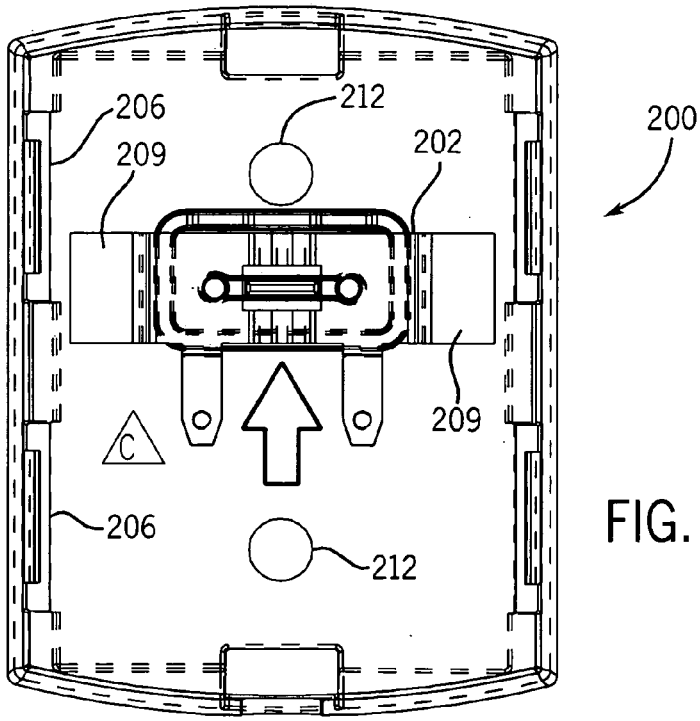
FIG. 10 is a schematic planar side view drawing of the housing illustrated in FIG. 9.

With reference to FIGS. 9 and 10, a housing 200 can be utilized with electronic device 15 and is configured to receive housings 52 and 54 of device 15 (FIG. 3). Housing 200 includes a contact bar or strip 202. A ridge between housings 52 and 54 is configured to receive tabs 206 when device 12 is placed within housing 200. Tabs 206 on a top and bottom, as well as a right side or left side can be utilized. Contacts 60 are configured to engage contact receiving areas 209 of strip 202. Strip 102 is bent to provide bias for engaging contacts 60.

Housing 200 includes apertures 212 for receiving fasteners to attach housing 200 to equipment 18. Advantageously, housing 54 of device 15 covers apertures 212 when engaged in housing 200 so that fasteners cannot be adjusted without removing electrical device 12 from housing 200 (without uncoupling alarm circuit 38 from strip 102). Alternative techniques for attaching housing 200 to equipment 18 can be utilized.

With reference to FIG. 9, in one alternative embodiment, a metal cable 220 can be coupled to contact bar 202. According to such an embodiment, contact strip 202 is open circuited between contact receiving areas 209. Wire 220 includes ends separately coupled to contact receiving areas 209. In this way, cable 220 can be wrapped around equipment 18 or a person 23. If wire 220 is cut or otherwise open circuited or if contacts 60 are uncoupled from contact areas 209, alarm circuit 38 can provide an alarm signal.

Figure 11:
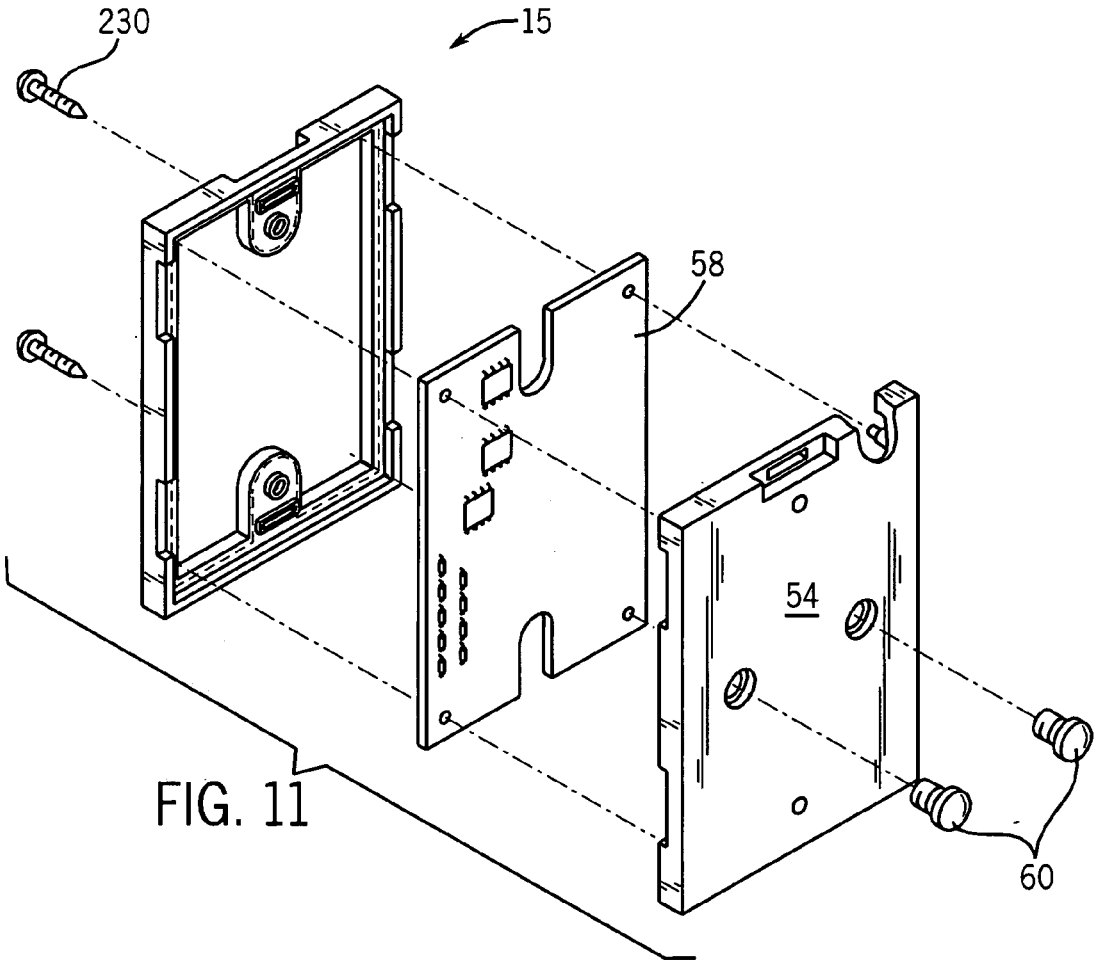
FIG. 11 is a schematic perspective exploded view drawing of the electronic device with the tamper detection system illustrated in FIG. 2 in accordance with still yet another exemplary embodiment.

With reference to FIG. 11, device 15 can be coupled through fasteners 230 directly to equipment 18. A conductive strip can be provided on the equipment to receive contacts 60. Alternatively, equipment 18 can include a conductive housing, which is received by contact 60. When fasteners 230 are removed and housing 54 is no longer in contact with the conductive strip or conductive surface of equipment 18, alarm circuit 38 provides the alarm signal.

Figure 12:
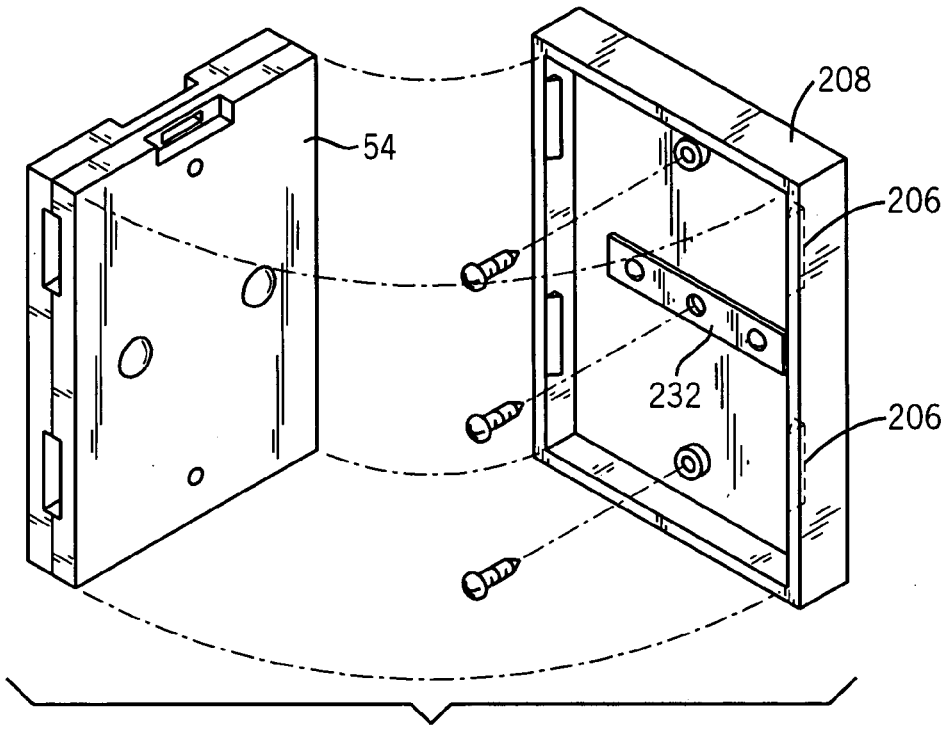
FIG. 12 is a schematic perspective exploded view drawing of the electronic device with the tamper detection system illustrated in FIG. 2 in accordance with a yet further exemplary embodiment.
Figure 13:
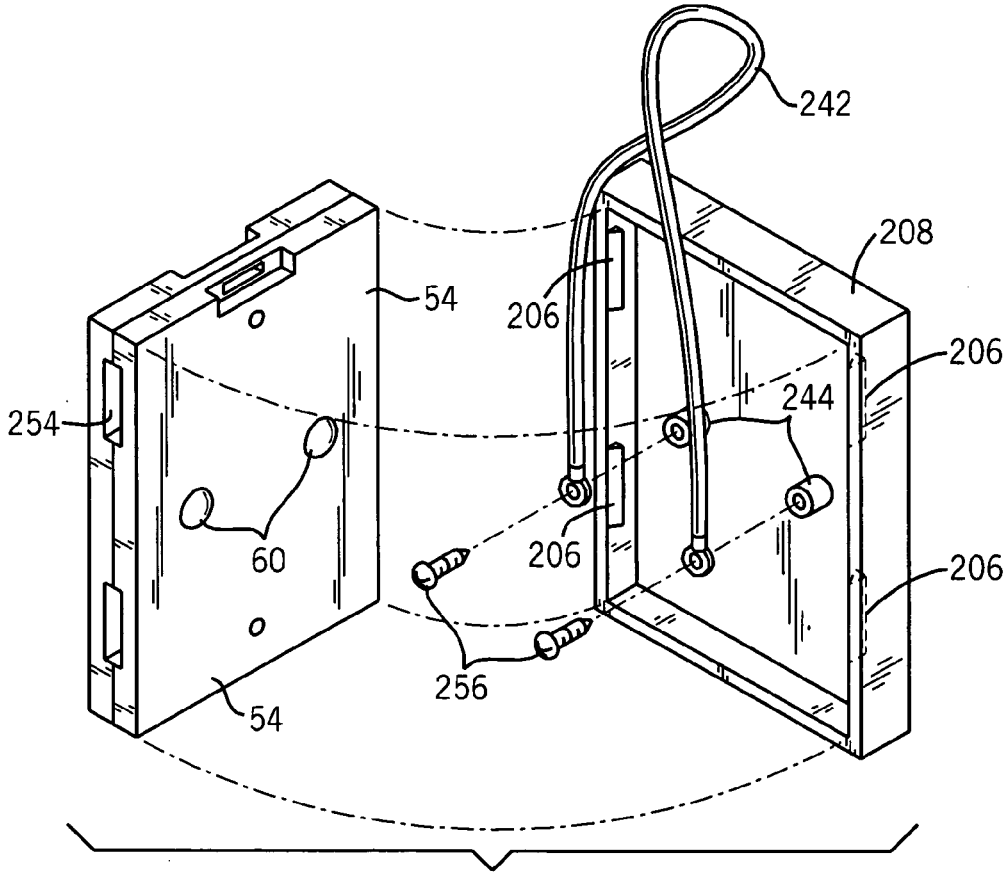
FIG. 13 is a schematic perspective exploded view drawing of the electronic device with the tamper detection system illustrated in FIG. 2 in accordance with yet still another exemplary embodiment.

With reference to FIG. 12, a housing 208 includes a flat horizontal contact bar 232 similar to contact bar 202. With reference to FIG. 13, housing 208 is configured to receive a cable 242. Cable 242 is preferably fastened to apertures 244. When device 15 is mounted in housing 208 via tabs 206 engaging slots 254, contacts 60 engage fasteners 256 to provide electrical coupling through cable 242.

It is understood that while the detailed descriptions, specific examples, material types, thickness, dimensions, and shapes discussed provide preferred exemplary embodiments of the present invention, the preferred exemplary embodiments are for the purpose of illustration only. The method and the system of the present invention are not limited to the precise details and conditions disclosed. For example, although specific types of adhesives are mentioned, other fastening materials can be utilized. Various changes will be made to the details disclosed without departing from the scope of the invention, which is defined by the following claims.

What is claimed is:

1. A tamper detection system for an electronic monitoring or security device, the system comprising:

a member having a first surface and a second surface, the second surface for being attached to a piece of equipment;

a sensing element disposed on the first surface of the member;

a housing attached to the first surface; and a circuit electrically coupled to the sensing element, the circuit providing an alarm signal in response to the sensing element being distorted, the circuit being disposed within the housing, the housing containing at least one circuit board and IC.

2. The tamper detection system of claim 1, further comprising a first adhesive disposed on the first surface, the first adhesive being used to attach the first surface to the housing.

3. The tamper detection system of claim 2, further comprising a second adhesive disposed on the second surface, the second surface being attached to the piece of equipment by the second adhesive.

4. The tamper detection system of claim 3, wherein the first adhesive has a first bond between the first adhesive and the housing and the second adhesive has a second bond between the second adhesive and the piece of equipment, the first bond being weaker than the second bond.

5. The tamper detection system of claim 1, wherein the member is a high bond coated acrylic foam tape.

6. The tamper detection system of claim 1, wherein the sensing element is a conductive trace.

7. The tamper detection system of claim 6, wherein the conductive trace includes an S-shaped portion.

8. The tamper detection system of claim 7, wherein the conductive trace is a foil material.

9. The tamper detection system of claim 7, wherein the circuit is coupled to the sensing element by a plurality of contacts.

10. The tamper detection system of claim 1, wherein the circuit determines if the resistance associated with the sensing element has changed.

11. An electronic monitoring or security system, the system comprising:

an electronic device for monitoring or securing a person or thing, the electronic device being an RF device in a housing, the housing containing a circuit board and an IC;

a member having a first surface and a second surface, the second surface being attached to the person or thing;

a sensing element disposed on the first surface of the member, the housing of the electronic device being attached to the first surface; and a circuit electrically coupled to the sensing element, the circuit providing an alarm signal in response to the sensing element being distorted.

12. The electronic monitoring or security system of claim 11, wherein the circuit is disposed in the electronic device.

13. The electronic monitoring or security system of claim 11, wherein the member is flexible and the sensing element is a conductive trace disposed on the member.

14. The electronic monitoring or security system of claim 11, further comprising:

a monitoring center, wherein the electronic device provides the alarm signal to the monitoring center.

15. The electronic monitoring or security system of claim 11, further comprising:

a first adhesive disposed on the first surface, the first adhesive being used to attach the first surface to the electronic device;

a second adhesive disposed on the second surface, the second surface being attached to the person or thing by the second adhesive, wherein the first adhesive has a first bond between the first adhesive and the housing and the second adhesive has a second bond between the second adhesive and the person or thing, the first bond being weaker than the second bond.

16. A tamper detection system for an electronic monitoring or security device, the system comprising:

a housing for being attached to a piece of equipment by a means for attaching, the housing holding a circuit board and IC associated with an electronic monitoring or security device or tag, the housing being configured so that the electronic monitoring or security device or tag covers the means for attaching when held in the housing;

a sensing element disposed on the housing between the electronic monitoring or security device or tag and the housing; and a circuit disposed with the electronic monitoring or security device or tag is electrically coupled to the sensing element, the circuit providing an alarm signal in response to the sensing element being uncoupled from the electronic monitoring or security device or tag.

* * * * *